US009605867B2

(12) United States Patent
Zakula et al.

(10) Patent No.: US 9,605,867 B2
(45) Date of Patent: Mar. 28, 2017

(54) LIGHTING AND VENTILATING SYSTEM AND METHOD

(71) Applicant: Broan-NuTone LLC, Hartford, WI (US)

(72) Inventors: Mirko Zakula, New Berlin, WI (US); Corey Scott Jacak, West Bend, WI (US); Kiyoshi Hoshino, Chesterfield, MO (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 14/683,992

(22) Filed: Apr. 10, 2015

(65) Prior Publication Data

US 2015/0211763 A1 Jul. 30, 2015

Related U.S. Application Data

(63) Continuation of application No. 13/745,200, filed on Jan. 18, 2013, now Pat. No. 9,004,723, which is a (Continued)

(51) Int. Cl.
*F24F 13/078* (2006.01)
*F21S 8/02* (2006.01)

(Continued)

(52) U.S. Cl.
CPC ..... *F24F 13/078* (2013.01); *F21S 8/026* (2013.01); *F21V 5/04* (2013.01); *F21V 15/02* (2013.01);

(Continued)

(58) Field of Classification Search
CPC .. F21S 8/024; F21S 8/026; F21S 8/035; F21S 8/02; F21S 8/04; F21V 15/02;

(Continued)

(56) References Cited

U.S. PATENT DOCUMENTS 2,189,008 A 2/1940 Kurth
2,359,021 A 9/1944 Campbell et al.

(Continued)

FOREIGN PATENT DOCUMENTS

AU 757000 B2 1/2003
AU 2003203584 B2 3/2006

(Continued)

OTHER PUBLICATIONS

"U.S. Appl. No. 12/902,077, Notice of Allowance mailed Oct. 23, 2012", 9 pgs.

(Continued)

*Primary Examiner* — Hargobind S Sawhney

(74) *Attorney, Agent, or Firm* — Schwegman Lundberg & Woessner, P.A.

(57) ABSTRACT

Embodiments of the invention provide a lighting and ventilating system including a main housing. The main housing can include an inlet through which air can be received within the main housing and an outlet through which the air can exit the main housing. A fan wheel can be supported in the main housing and it can be operable to generate a flow of air. A grille can be coupled to the main housing and the grille can comprise a plurality of apertures and a second set of illumination devices. The system further can include a lamp housing coupled to the grille, the lamp housing can include a first set of illumination devices. Also, a plate can be coupled to the grille so that the plate is adjacent to the second set of illumination devices.

17 Claims, 8 Drawing Sheets

Related U.S. Application Data continuation of application No. 12/902,077, filed on Oct. 11, 2010, now Pat. No. 8,382,332.

(51) Int. Cl.

| | |
|---|---|
| ***F21V 23/04*** | (2006.01) |
| ***F21V 29/67*** | (2015.01) |
| ***F21V 5/04*** | (2006.01) |
| ***F21V 15/02*** | (2006.01) |
| ***F21V 23/00*** | (2015.01) |
| ***F21V 33/00*** | (2006.01) |
| *F21W 131/30* | (2006.01) |
| *F21Y 101/00* | (2016.01) |
| *F21Y 103/33* | (2016.01) |
| *F21Y 113/20* | (2016.01) |
| *F21Y 115/10* | (2016.01) |

(52) U.S. Cl.

CPC ..... *F21V 23/003* (2013.01); *F21V 23/0464* (2013.01); *F21V 23/0471* (2013.01); *F21V 29/673* (2015.01); *F21V 29/677* (2015.01); *F21V 33/0096* (2013.01); *F21W 2131/30* (2013.01); *F21Y 2101/00* (2013.01); *F21Y 2103/33* (2016.08); *F21Y 2113/20* (2016.08); *F21Y 2115/10* (2016.08)

(58) Field of Classification Search

CPC .... F21V 23/003; F21V 23/007; F21V 29/673; F21V 29/677; F21V 33/0092; F21V 33/0096; F21V 33/0088; F21V 21/04; F21Y 2101/02; F21Y 2103/003; F21Y 2113/02; F21Y 2101/00; F21Y 2103/10; F21Y 2103/33; F24F 13/078; F24F 7/007; F24F 7/025; F24H 3/0411

See application file for complete search history.

(56) References Cited

U.S. PATENT DOCUMENTS

| | | | |
|---|---|---|---|
| 3,701,895 | A | 10/1972 | Sweetser |
| 4,142,227 | A | 2/1979 | Aikens |
| 4,681,024 | A | 7/1987 | Ivey |
| 5,021,932 | A | 6/1991 | Ivey |
| 5,278,432 | A | 1/1994 | Ignatius et al. |
| 5,909,534 | A | 6/1999 | Ko |
| 5,918,972 | A | 7/1999 | Van Belle |
| 6,016,038 | A | 1/2000 | Mueller et al. |
| 6,033,212 | A | 3/2000 | Bonnema et al. |
| 6,059,421 | A | 5/2000 | White et al. |
| 6,095,671 | A | 8/2000 | Hutain |
| 6,150,774 | A | 11/2000 | Mueller et al. |
| 6,211,626 | B1 | 4/2001 | Lys et al. |
| 6,292,901 | B1 | 9/2001 | Lys et al. |
| 6,340,868 | B1 | 1/2002 | Lys et al. |
| 6,406,673 | B1 | 6/2002 | Soller et al. |
| 6,483,247 | B2 | 11/2002 | Edwards et al. |
| 6,484,438 | B2 | 11/2002 | Matsunaga et al. |
| 6,558,003 | B2 | 5/2003 | Mihara |
| 6,783,081 | B2 | 8/2004 | Pedrotti et al. |
| 6,788,011 | B2 | 9/2004 | Mueller et al. |
| 6,888,322 | B2 | 5/2005 | Dowling et al. |
| 6,948,829 | B2 | 9/2005 | Verdes et al. |
| 6,965,205 | B2 | 11/2005 | Piepgras et al. |
| 6,967,448 | B2 | 11/2005 | Morgan et al. |
| D518,218 | S | 3/2006 | Roberge et al. |
| 7,014,336 | B1 | 3/2006 | Ducharme et al. |
| 7,021,799 | B2 | 4/2006 | Mizuyoshi |
| 7,064,498 | B2 | 6/2006 | Dowling et al. |
| 7,113,541 | B1 | 9/2006 | Lys et al. |
| 7,132,785 | B2 | 11/2006 | Ducharme |
| 7,161,311 | B2 | 1/2007 | Mueller et al. |
| 7,180,252 | B2 | 2/2007 | Lys et al. |
| 7,186,003 | B2 | 3/2007 | Dowling et al. |
| 7,246,919 | B2 | 7/2007 | Porchia et al. |
| D548,868 | S | 8/2007 | Roberge et al. |
| 7,256,554 | B2 | 8/2007 | Lys |
| 7,318,659 | B2 | 1/2008 | Demarest et al. |
| D562,494 | S | 2/2008 | Piepgras |
| 7,341,698 | B2 | 3/2008 | Pedrotti et al. |
| D566,323 | S | 4/2008 | Piepgras et al. |
| 7,352,138 | B2 | 4/2008 | Lys et al. |
| 7,352,339 | B2 | 4/2008 | Morgan et al. |
| D568,460 | S | 5/2008 | Jacak et al. |
| D569,492 | S | 5/2008 | Zakula et al. |
| D575,386 | S | 8/2008 | Jacak et al. |
| 7,419,281 | B2 | 9/2008 | Porchia et al. |
| 7,427,840 | B2 | 9/2008 | Morgan et al. |
| 7,459,864 | B2 | 12/2008 | Lys |
| 7,462,997 | B2 | 12/2008 | Mueller et al. |
| 7,470,043 | B2 | 12/2008 | Mehta |
| 7,476,002 | B2 | 1/2009 | Wolf et al. |
| 7,484,860 | B2 | 2/2009 | Demarest et al. |
| 7,490,954 | B2 | 2/2009 | Mayer et al. |
| 7,500,760 | B2 | 3/2009 | Byrne |
| 7,503,675 | B2 | 3/2009 | Demarest et al. |
| 7,524,089 | B2 | 4/2009 | Park |
| 7,557,521 | B2 | 7/2009 | Lys |
| 7,611,263 | B2 | 11/2009 | Huang et al. |
| 7,646,029 | B2 | 1/2010 | Mueller et al. |
| 7,651,253 | B2 | 1/2010 | Shuy |
| 7,659,673 | B2 | 2/2010 | Lys |
| 7,703,951 | B2 | 4/2010 | Piepgras et al. |
| 7,828,465 | B2 | 11/2010 | Roberge et al. |
| 7,835,631 | B2 | 11/2010 | Wang et al. |
| 7,883,226 | B2 | 2/2011 | Li |
| 7,910,899 | B2 | 3/2011 | Platsch |
| 7,967,482 | B2 | 6/2011 | Horng et al. |
| 8,000,594 | B2 | 8/2011 | Messina |
| 8,149,206 | B2 * | 4/2012 | Kim ..... G09G 3/3426 345/102 |
| 8,203,274 | B2 | 6/2012 | De Castro |
| 8,240,885 | B2 | 8/2012 | Miller |
| 8,246,171 | B2 | 8/2012 | Chen et al. |
| 8,246,202 | B2 | 8/2012 | Mart et al. |
| 8,251,689 | B2 | 8/2012 | Custer |
| 8,313,221 | B2 | 11/2012 | Hsu |
| 8,317,370 | B2 | 11/2012 | Chien et al. |
| 8,382,332 | B2 | 2/2013 | Zakula et al. |
| 8,485,696 | B2 | 7/2013 | Pringle et al. |
| 8,967,832 | B2 | 3/2015 | Zakula et al. |
| 9,004,723 | B2 | 4/2015 | Zakula et al. |
| 2003/0036030 | A1 | 2/2003 | Doppelt |
| 2005/0111840 | A1 * | 5/2005 | Craw ..... F24H 3/0411 392/350 |
| 2007/0091057 | A1 * | 4/2007 | Lee ..... G09G 3/3413 345/102 |
| 2007/0109763 | A1 | 5/2007 | Wolf et al. |
| 2007/0175085 | A1 | 8/2007 | Chen |
| 2007/0228999 | A1 | 10/2007 | Kit |
| 2007/0230183 | A1 | 10/2007 | Shuy |
| 2008/0066372 | A1 | 3/2008 | Fleming |
| 2008/0232091 | A1 | 9/2008 | Abbondanzio et al. |
| 2008/0285271 | A1 | 11/2008 | Roberge et al. |
| 2009/0009985 | A1 | 1/2009 | Mehta |
| 2009/0290343 | A1 | 11/2009 | Brown et al. |
| 2010/0009621 | A1 * | 1/2010 | Hsieh ..... F21V 33/0096 454/293 |
| 2010/0027276 | A1 | 2/2010 | Kornitz et al. |
| 2010/0284149 | A1 * | 11/2010 | Su ..... H05K 7/20909 361/695 |
| 2011/0051414 | A1 | 3/2011 | Bailey et al. |
| 2011/0139894 | A1 | 6/2011 | Masterson et al. |
| 2011/0188241 | A1 | 8/2011 | Walczak et al. |
| 2011/0273871 | A1 | 11/2011 | Fukui |
| 2012/0087128 | A1 | 4/2012 | Zakula et al. |
| 2012/0087138 | A1 | 4/2012 | Pringle et al. |
| 2013/0128575 | A1 | 5/2013 | Zakula et al. |
| 2015/0167990 | A1 | 6/2015 | Zakula et al. |

(56) References Cited

U.S. PATENT DOCUMENTS

FOREIGN PATENT DOCUMENTS

| | | | |
|---|---|---|---|
| CA | 2302227 | C | 3/1999 |
| CN | 201041297 | Y | 3/2008 |
| CN | 201437947 | U | 4/2010 |
| CN | 201575552 | U | 9/2010 |
| EP | 1016062 | B1 | 8/2002 |
| EP | 1234140 | B1 | 8/2005 |
| FR | 2614390 | A1 | 10/1988 |

OTHER PUBLICATIONS

"Chinese Application Serial No. 201110462251.8, Office Action mailed May 25, 2015", (w/ English Translation), 19 pgs.
"U.S. Appl. No. 12/902,065, Non Final Office Action mailed Nov. 8, 2012", 12 pgs.
"U.S. Appl. No. 12/902,065, Notice of Allowance mailed Mar. 26, 2013", 8 pgs.
"U.S. Appl. No. 12/902,065, Response filed Feb. 8, 2013 to Non Final Office Action mailed Nov. 8, 2012", 21 pgs.
"U.S. Appl. No. 13/190,386, Advisory Action mailed Feb. 10, 2014", 3 pgs.
"U.S. Appl. No. 13/190,386, Final Office Action mailed Oct. 15, 2013", 12 pgs.
"U.S. Appl. No. 13/190,386, Non Final Office Action mailed Apr. 9, 2013", 13 pgs.
"U.S. Appl. No. 13/190,386, Non Final Office Action mailed Jun. 12, 2014", 12 pgs.
"U.S. Appl. No. 13/190,386, Notice of Allowance mailed Oct. 24, 2014", 11 pgs.
"U.S. Appl. No. 13/190,386, Pre-Appeal Brief Request Mar. 14, 2014", 5 pgs.
"U.S. Appl. No. 13/190,386, Response filed Jun. 28, 2013 to Non Final Office Action mailed Apr. 9, 2013", 18 pgs.
"U.S. Appl. No. 13/190,386, Response filed Sep. 2, 2014 to Non Final Office Action mailed Jun. 12, 2014", 10 pgs.
"U.S. Appl. No. 13/190,386, Response filed Dec. 12, 2013 to Final Office Action mailed Oct. 15, 2013", 18 pgs.
"U.S. Appl. No. 13/745,200, Final Office Action mailed Oct. 18, 2013", 10 pgs.
"U.S. Appl. No. 13/745,200, Non Final Office Action mailed Apr. 24, 2013", 9 pgs.
"U.S. Appl. No. 13/745,200, Notice of Allowance mailed Jan. 26, 2015", 9 pgs.
"U.S. Appl. No. 13/745,200, Notice of Allowance mailed Sep. 17, 2014", 11 pgs.
"U.S. Appl. No. 13/745,200, Response filed Apr. 18, 2014 to Final Office Action mailed Oct. 18, 2013", 12 pgs.
"U.S. Appl. No. 13/745,200, Response filed Jul. 24, 2013 to Non Final Office Action mailed Apr. 24, 2013", 16 pgs.
"U.S. Appl. No. 14/631,306, Preliminary Amendment filed Feb. 26, 2015", 7 pgs.
"Chinese Application Serial No. 201110462251.8, Office Action mailed Nov. 3, 2014", (w/ English Translation), 21 pgs.
"Chinese Application Serial No. 201110463051.4, Office Action mailed Feb. 13, 2015", 18 pgs.
"Chinese Application Serial No. 201110462251.8, Office Action mailed Oct. 13, 2015", (w/ English Translation), 9 pgs.
"Chinese Application Serial No. 201110462251.8, Response filed Jan. 28, 2016 to Office Action mailed Oct. 13, 2015", 9 pgs.
"Chinese Application Serial No. 201110462251.8, Response filed Jul. 28, 2015 to Office Action mailed May 25, 2015", 7 pgs.
"Chinese Application Serial No. 201110463051.4, Office Action mailed Nov. 5, 2015", (w/ English Translation), 13 pgs.
"Chinese Application Serial No. 201110463051.4, Response filed Jan. 11, 2016 to Office Action mailed Nov. 5, 2015", (English Translation of Claims), 31 pgs.
"Chinese Application Serial No. 201110463051.4, Response filed Jul. 2, 2015 to Office Action mailed Feb. 13, 2015", (English Translation of Claims), 4 pgs.
"Chinese Application Serial No. 201110462251.8, Office Action mailed May 4, 2016", (w/ English Translation), 18 pg.
"Chinese Application Serial No. 201110462251.8, Response filed Jul. 15, 2016 to Office Action mailed May 4, 2016", W/ English Translation of Claims, 12 pgs.
"Chinese Application Serial No. 201110463051.4, Office Action mailed May 19, 2016", (w/ English Translation), 13 pgs.
"Chinese Application Serial No. 201110463051.4, Response filed Jul. 29, 2016 to Office Action mailed May 19, 2016", W/ English Translation of Claims, 12 pgs.
"Chinese Application Serial No. 201110463051.4, Office Action mailed Nov. 25, 2016".

* cited by examiner

LIGHTING AND VENTILATING SYSTEM AND METHOD

RELATED APPLICATIONS

This application is a continuation of U.S patent application Ser. No. 13/745,200, filed Jan. 18, 2013 and entitled "Lighting and Ventilating System and Method," which is a continuation of U.S. patent application Ser. No. 12/902,077, filed on Oct. 11, 2010 and entitled "Lighting and Ventilating System and Method" the disclosure of which applications are herein incorporated by reference in their entirety.

BACKGROUND

Conventional lighting and ventilating systems can combine elements of a conventional room ventilating fan with a light fixture. These apparatuses can have a bulky, unaesthetic appearance, can employ a complicated design, can fail to adequately cool the light fixture, and or can employ a design where the components of the apparatus are inefficiently arranged. Additionally, many conventional lighting and ventilating systems can include only one illumination source which can be lacking in some functionality, which can include providing quiescent lighting.

SUMMARY

Some embodiments of the invention provide a lighting and ventilating system including a main housing. The main housing can include an inlet through which air can be received within the main housing and an outlet through which the air can exit the main housing. A fan wheel can be supported in the main housing and it can be operable to generate a flow of air. A grille can be coupled to the main housing and the grille can comprise a plurality of apertures and a second set of illumination devices. The system further can include a lamp housing coupled to the grille, the lamp housing can include a first set of illumination devices. Also, a plate can be coupled to the grille so that the plate is adjacent to the second set of illumination devices.

Some embodiments of the invention provide a lighting and ventilating system including a main housing. The main housing can include an inlet through which air can be received within the main housing and an outlet through which the air can exit the main housing. A fan wheel can be supported in the main housing and it can be operable to generate a flow of air. A grille can be coupled to the main housing and the grille can include a region, the region can comprise a lamp aperture and light-emitting diodes. A lamp housing can be coupled to the grille substantially adjacent to the lamp aperture, and the lamp housing can including a first set of illumination devices. Also, a plate can be coupled to the system, and the plate can include a plate aperture.

Some embodiments of the invention provide a method for lighting a space including providing a main housing and a grille which can be coupled to the main housing with the grille comprising a second set of illumination devices. Some embodiments can include a lamp housing which can be coupled to the grille, and the lamp housing can include a first set of illumination devices. Also included can be providing a plate which can be coupled to the grille so that the plate can be adjacent to the second set of illumination devices. Some embodiments can include activating the second set of illumination devices and deactivating the first set of illumination devices when the space is generally unoccupied by a user and generally lacks other illumination, and activating the first set of illumination devices and deactivating the second set of illumination devices when the space is generally occupied by the user.

DETAILED DESCRIPTION

Figure 1:
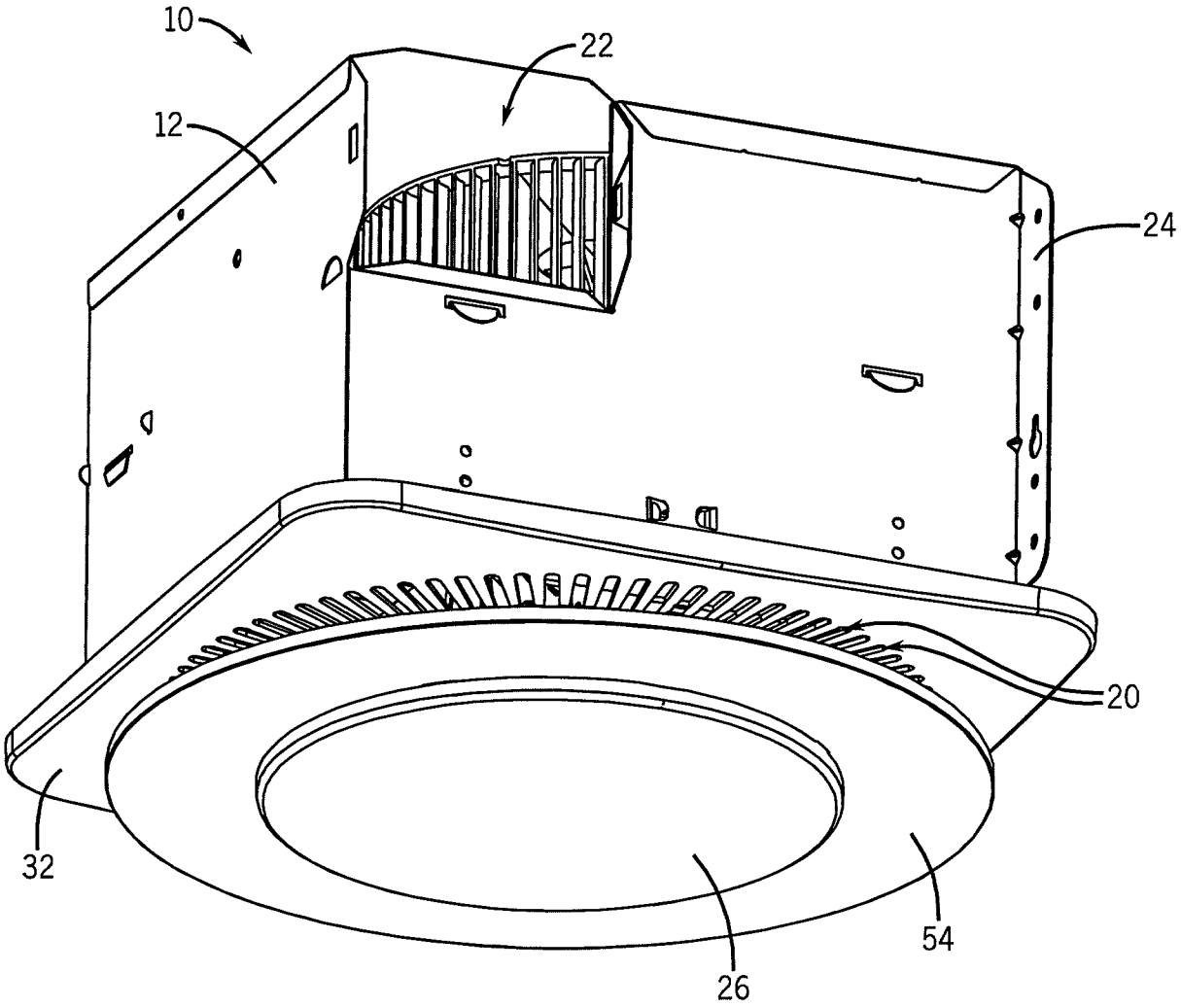
FIG. 1 is a perspective view of a lighting and ventilating system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a lighting and ventilating system 10 according to one embodiment of the invention. Some embodiments of the system 10 generally can include several components and devices which can perform various functions. In some embodiments of the present invention, the system 10 can include a main housing 12, which can house components of the system 10. The system 10 generally can include a ventilating assembly 14, a lamp housing 16, a first set of illumination devices 18, a plurality of apertures 20, a ventilation outlet 22, at least one mounting apparatus 24 which can be used to mount the lighting and ventilating system 10 to a surface or a support structure, electrical components, a lens 26, a motor 28, and at least one electrical socket 30.

In some embodiments, the system 10 can be used to illuminate and/or ventilate any room, area, or space. In some embodiments, the system 10 can illuminate the room, area, or space independently of ventilating the room, area, or space. Further, in some embodiments, the system 10 can provide different intensities of illumination to the room, area, or space.

As shown in FIG. 1, in some embodiments, the main housing 12 can comprise any material which can withstand varying temperatures (i.e., to withstand any heat radiated and/or conducted from the illumination devices, the motor, or other components) while providing structural support to the system 10. In some embodiments, the main housing 12 can be formed of sheet metal, however, the main housing 12 also can be fabricated from ceramic or a polymer comprising a relatively high melting temperature. The main housing 12 can be formed into any shape, including, but not limited to, a rectangular box-like shape, an oval shape, a hemispherical shape, a spherical shape, a pyramidal shape, or any other shape. The main housing 12 can form a base or a similar support structure of the system 10. Further, in some embodiments, the main housing 12 can provide points and areas of attachment for other components of the system 10.

As shown in FIG. 1, in some embodiments, the main housing 12 can include or can be used in conjunction with at least one mounting apparatus 24 for installing the system 10 to any variety of support structures or surfaces. Any type of mounting apparatus 24 can be included with the main housing 12. In some embodiments, the main housing 12 can include two mounting apparatuses 24 fabricated from sheet metal. Although the mounting apparatuses 24 can be positioned anywhere on the main housing 12 so that the main housing can be supported with respect to any surrounding structure into which it can be installed, in some embodiments, the mounting apparatuses 24 can be positioned along opposite walls of the main housing 12. In other embodiments, the main housing 12 can be coupled to a support structure or a surface using a variety of fasteners and coupling methods (not shown).

In some embodiments of the invention, a grille 32 can be coupled to the main housing 12. In some embodiments, the grille 32 can be formed in a generally square-like shape, although the grille 32 can take any shape, including an oval shape, a hemispherical shape, a spherical shape, a pyramidal shape, or any other shape. Further, in some embodiments, the grille 32 can be configured so that it substantially matches the shape of the main housing 12. The grille 32 can be formed from injection-molded polymers, injection-molded polycarbonate, sheet metal, or any other suitable material.

Figure 7:
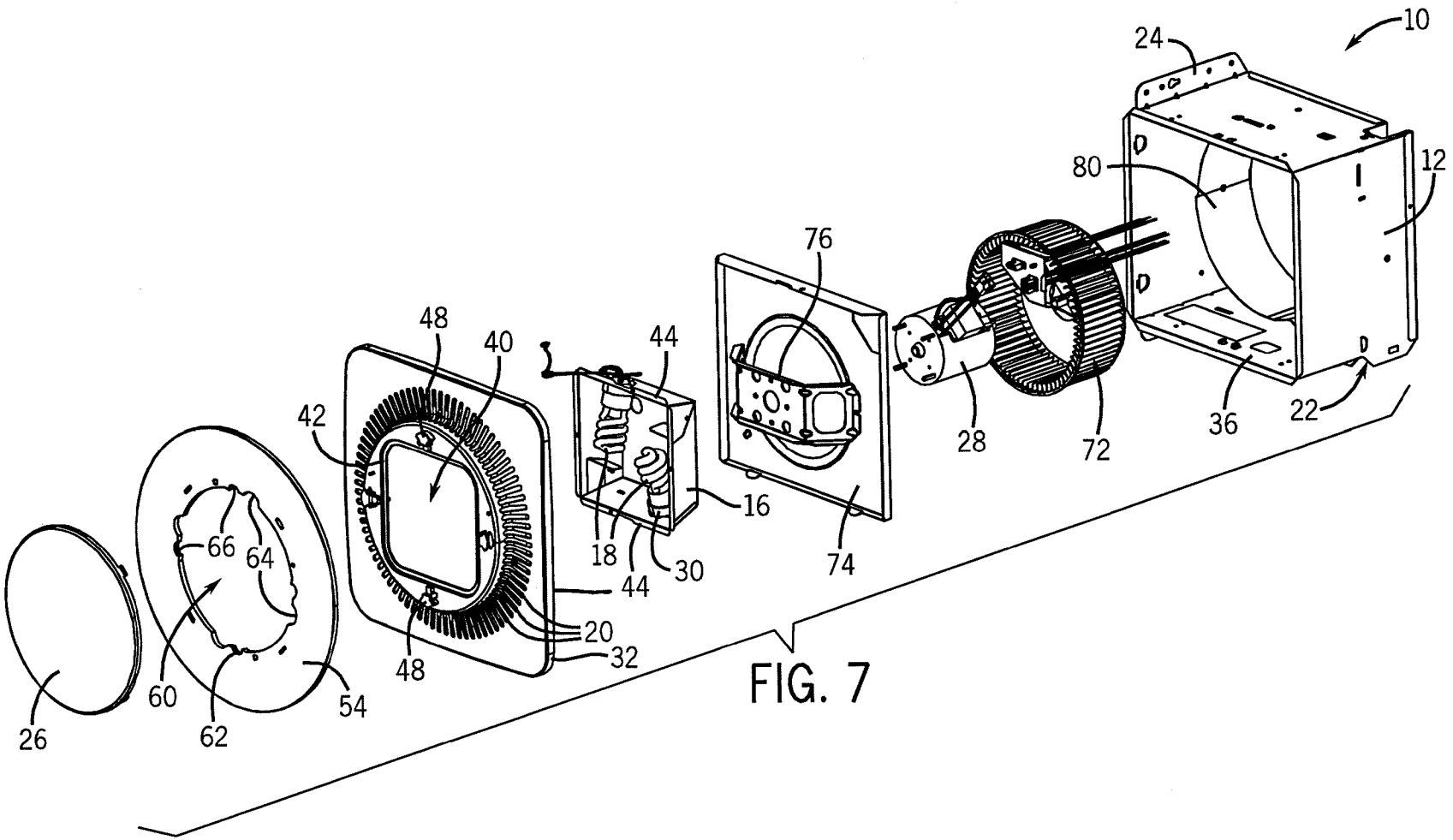
FIG. 7 is an exploded view of a lighting and ventilating system according to one embodiment of the invention.

As shown in FIGS. 1 and 7, in some embodiments, the grille 32 can be positioned over an open end of the main housing 12. In some embodiments, the open end of the main housing 12 can be shaped and dimensioned to be received within an open end of the grille 32. The grille 32 can be secured to the main housing 12 by one or more snap-fit features on the grille 32 and/or the main housing 12. Additionally, in some embodiments, the one or more snap-fit features can be supplemented or largely replaced by any variety of couplings, such as screws, grille springs, bolts, rivets, pins, clamps, glue or other adhesive, and any other similar coupling. In some embodiments, the main housing 12 and the grille 32 can be further secured through other coupling practices such as welding, soldering, brazing, adhesive or cohesive bonding material, any combination of the foregoing, or any other similar coupling practice.

Figure 2:
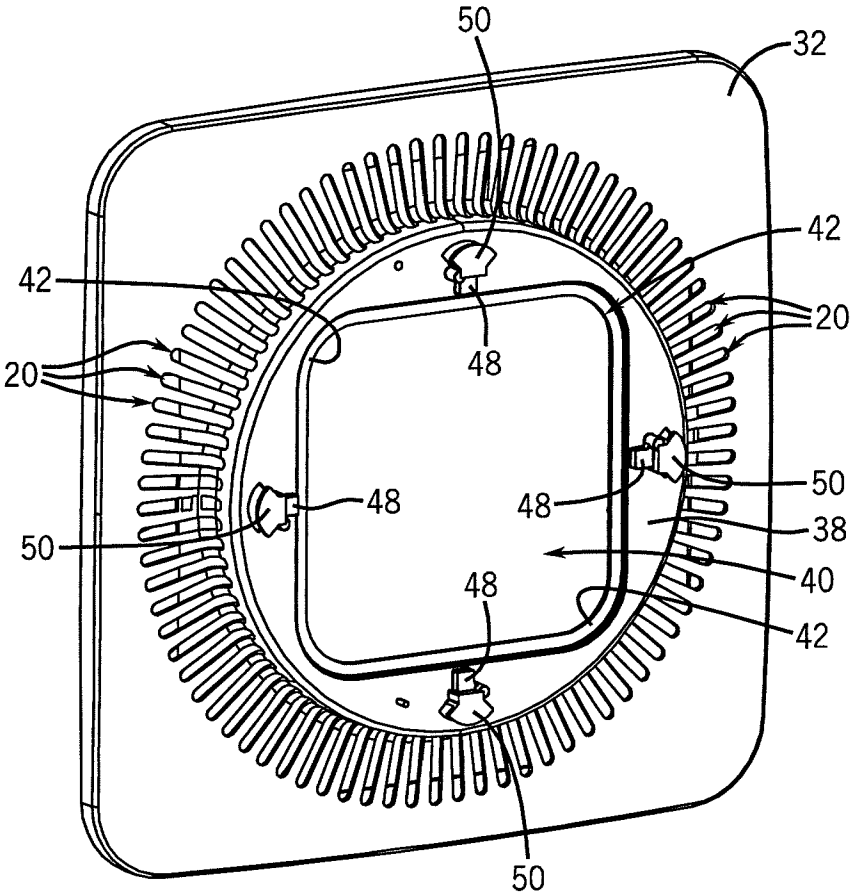
FIG. 2 is a perspective view of a grille according to one embodiment of the invention.
Figure 3:
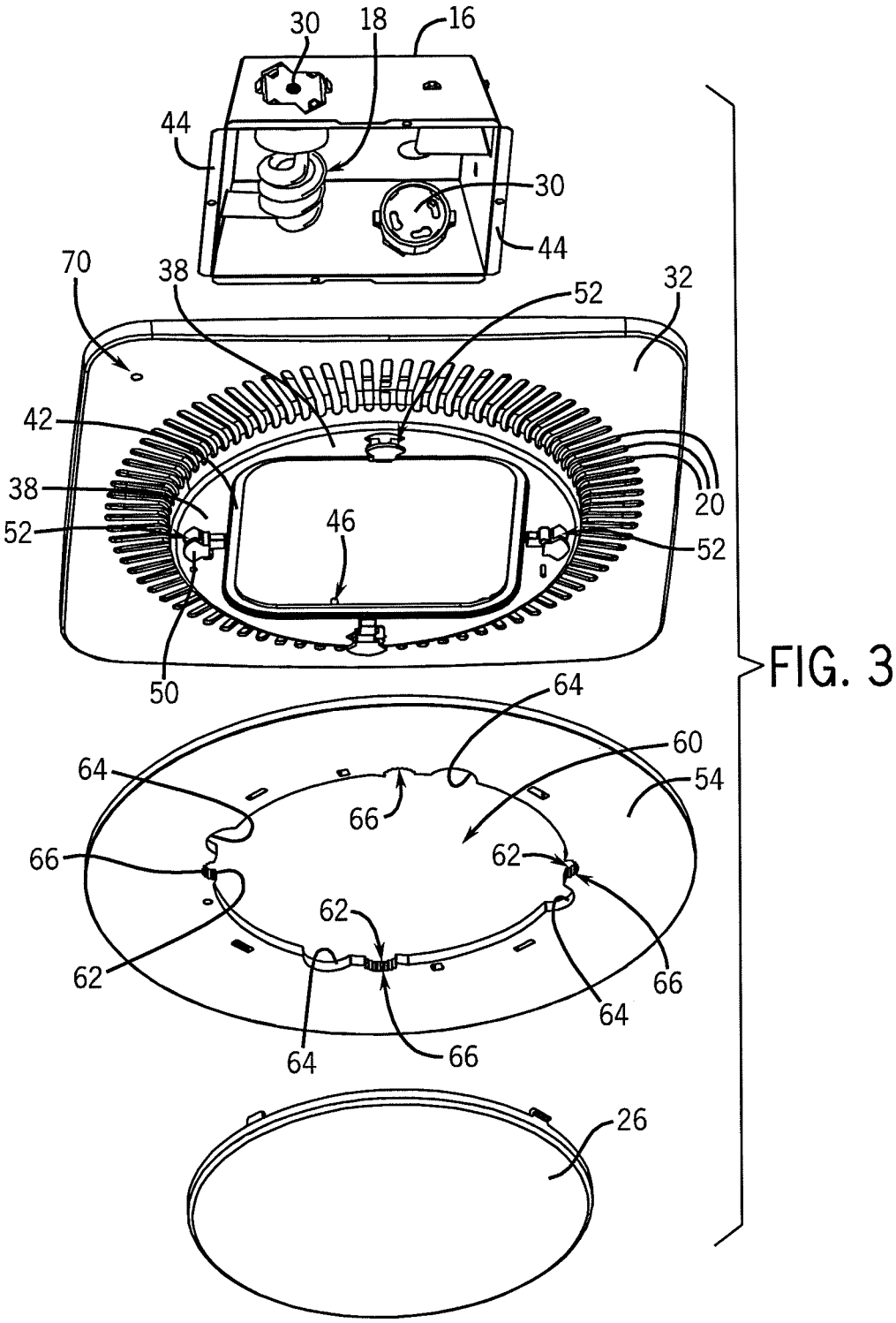
FIG. 3 is a perspective of a lamp housing, grille, plate, and lens according to one embodiment of the invention.

Referring to FIGS. 1-3, in some embodiments, the main housing 12 can include one or more lips, flared edges, flanges, or other features to which the grille 32 can be coupled. In some embodiments, the main housing 12 can include a first set of peripheral flanges 34 to which the grille 32 can be coupled. In other embodiments, the grille 32 can be shaped and dimensioned to be received within the main housing 12 and the grille 32 can be coupled to the main housing 12 using any of the above described methods. In some embodiments, the grille 32 and the main housing 12 can include apertures through which fasteners can be passed to couple the grille 32 and the main housing 12. Any of the previously described couplings can be used to couple the grille 32 and the main housing 12.

In some embodiments of the invention, the grille 32 can include the plurality of apertures 20. In some embodiments, the plurality of apertures 20 can extend across an inlet 36, which can be defined by the main housing 12. The plurality of apertures 20 can be used for receiving a flow of air. The plurality of apertures 20 can be located anywhere on the grille 32. In some embodiments, the location of the plurality of apertures 20 can be at least partially determined by airflow path(s) which can be available from the plurality of apertures 20, through the inlet 36, and into the ventilating assembly 14. In some embodiments, the plurality of apertures 20 can be located substantially around a perimeter of a region 38 of the grille 32. In some embodiments, the location of the plurality of apertures 20 can be selected substantially based on aesthetics, functionality, and other considerations which can be important to a user and/or a manufacturer.

As best seen in FIGS. 2 and 3, in some embodiments, the plurality of apertures 20 can guide air into the system 10. Air can include moisture, steam, exhaust, smoke, effluent, or anything similar. In some embodiments, after passing through the plurality of apertures 20 and entering the inlet 36 of the main housing 12, the air can enter the ventilating assembly 14, which can be included in the main housing 12, as discussed below. In some embodiments, the ventilating assembly 14 can be operable to discharge the airflow to another location, such as an attic, outside of the structure in which the system 10 can be secured, and/or to a duct network. Further, the airflow can be discharged from the ventilation outlet 22 of the main housing 12, in some embodiments.

Referring to FIGS. 2 and 3, in some embodiments, portions of the grille 32 adjacent to the region 38 which can define the plurality of apertures 20 can include a substantially curved area. Substantially curved can include arched, arced, angled, bent, bowed, curled, rounded, warped, or any other deviation from substantially planar. In other embodiments, the portions of the grille 32 which can define the plurality of apertures 20 can be substantially planar.

According to some embodiments, the region 38 can be located in a generally central area of the grille 32. In other embodiments, the region 38 can be located generally anywhere on the grille 32. In yet other embodiments, the region 38 can include multiple regions 38 located in either generally central areas of the grille 32 or anywhere on the grille 32. In some embodiments, the region 38 can take a generally annular shape. In other embodiments, the region 38 can take other shapes, including square, rectangular, polygonal, spherical, elliptical, or any other shape.

In some embodiments of the invention, the region 38 can include a horizontal plane and the grille 32 can include a horizontal plane. In some embodiments, the horizontal plane of the region 38 can be substantially parallel to the horizontal plane of the grille 32, but the two horizontal planes need not be congruent. More specifically, in some embodiments, the region 38 can be generally elevated with respect to the grille 32. In other embodiments, the region 38 can be generally recessed with respect to the grille 32. In other embodiments, the horizontal planes of both the grille 32 and the region 38 can be substantially congruent so that the entire grille 32 can be generally planar.

As shown in FIG. 2, in some embodiments, the portions of the grille 32 which can include the substantially curved area can be curved in a direction so that the grille 32 and the region 38 can contact each other. In some embodiments where the region 38 can be elevated with respect to the grille 32, the substantially curved area can curve in a generally upward direction so that the region 38 and the grille 32 can contact each other. More specifically, the region 38 can reside as a plateau connected to the grille 32, but on a different horizontal plane with the substantially curved area included between the two elements. In some embodiments where the region 38 can be recessed with respect to the grille 32, the substantially curved area can curve in a generally downward direction so that the region 38 and the grille 32 can contact each other. In other embodiments, the substantially curved area can be substantially planar so that the grille 32 and the region can be generally positioned in one horizontal plane. In some embodiments, the grille 32 and the region 38 can both be formed in one unit so that the grille 32 and the region 32 are integral. In some embodiments, the grille 32 and the region 32 can be formed from at least two different subunits and coupled together. The grille 32 and the region 32 can be coupled using any of the methods described above.

Referring to FIG. 3, in some embodiments of the invention, the region 38 can include a lamp aperture 40. The lamp aperture 40 can be defined in a generally central location within the region 38, in some embodiments. In other embodiments, the lamp aperture 40 can be defined anywhere within the region 38 or the grille 32. In some embodiments, the lamp aperture 40 can be generally annular, however the lamp aperture 40 also can be generally square, rectangular, polygonal, spherical, elliptical, or any other shape. In some embodiments the shape of the lamp aperture 40 can be selected based on the shape of the lamp housing 16.

In some embodiments, the lamp housing 16 can be shaped and dimensioned to be received by the lamp aperture 40. In some embodiments, the lamp housing 16 can include a heat-resistant material, heat shielding, and/or a reflective surface to inhibit heat from contacting various components of the system 10. In some embodiments, the reflective surface can generally direct light out the system 10. In some embodiments, the lamp aperture 40 can generally support, hold, or sustain the lamp housing 16. In some embodiments, the lamp aperture 40 can include a mounting flange 42 which can be used to support the lamp housing 16. The mounting flange 42 can be located substantially entirely around the inner diameter of the lamp aperture 40 and can be integral with the lamp aperture 40. In other embodiments, the mounting flange 42 can be a plurality of mounting flanges located around the inner diameter of the lamp aperture 40.

Figure 4:
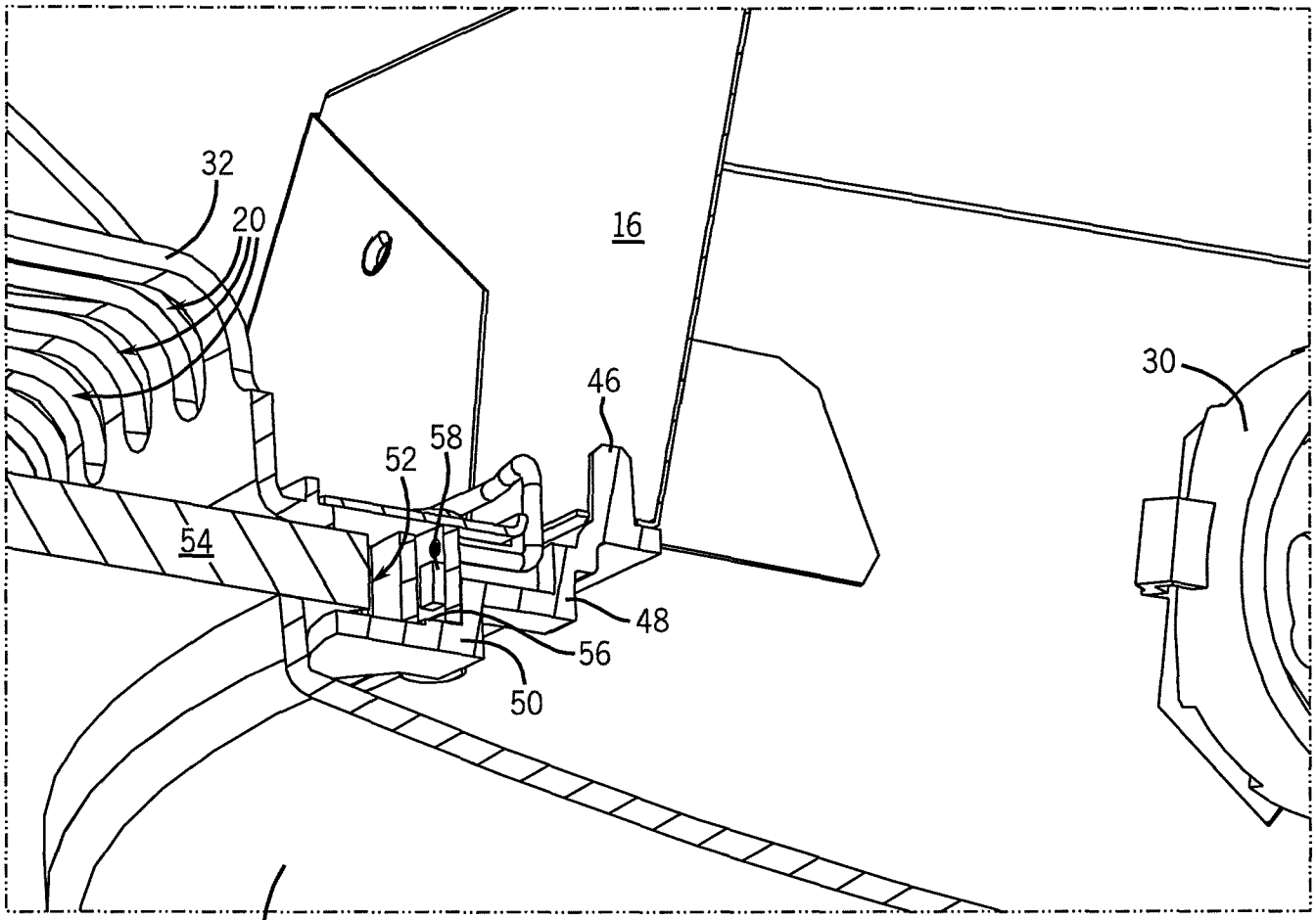
FIG. 4 is a cross section of a lighting and ventilating system according to one embodiment of the invention.

As shown in FIGS. 3-4, in some embodiments, the lamp housing 16 can be secured to the mounting flange 42 by one or more snap-fit features on the lamp housing 16 and/or the mounting flange 42. Additionally, in some embodiments, the one or more snap-fit features can be supplemented or largely replaced by any variety of coupling, such as screws, bolts, rivets, pins, clamps, glue or other adhesive, and any other similar fastener. In some embodiments, the lamp housing 16 and the mounting flange 42 can be further secured through other coupling practices such as welding, soldering, brazing, adhesive or cohesive bonding material, any combination of the foregoing, or any other similar coupling practice.

Referring to FIG. 3, in some embodiments, the lamp housing 16 can include one or more lips, flared edges, flanges, or other features to which the mounting flange 42 can be coupled. In some embodiments, the lamp housing 16 can include a second set of peripheral flanges 44 to which the mounting flange 42 can be attached. In some embodiments, the mounting flange 42 can include a set of pins 46 which can be received by a set of apertures included on the second set of peripheral flanges 44. In some embodiments, the connection between the pins 46 and the apertures of the flanges 44 can be further secured using any of the previously mentioned coupling methods. Further, in some embodiments, the mounting flange 42 and the lamp housing 16 can include apertures through which any of the above-discussed fasteners/couplers can be passed to secure the mounting flange 42 to the lamp housing 16. In some embodiments, the lamp housing 16 can be directly coupled to the region 38 and/or the grille 32 in any suitable manner. Further, in some embodiments, the lamp housing 16 can be directly coupled to the main housing 12 in any suitable manner.

In some embodiments, the lamp housing 16 can include the electrical sockets 30 and the first set of illumination devices 18, although some embodiments can include only one electrical socket 30 and one illumination device 18. In some embodiments, the electrical sockets 30 can be connected to the electrical components. The illumination devices 18 can contact the electric sockets 30, and, in some embodiments, when activated by the user, the illumination devices 18 can provide illumination to the room, area, or space. In some embodiments, the illumination devices 18 can include incandescent, fluorescent, compact fluorescent, halogen, and other lights and lamps. Further, these lights can be flood lights, globe lights, light-emitting diodes (LEDs), or other similar lighting apparatuses, including a combination of any of the above.

Referring to FIGS. 2-3, in some embodiments, the illumination devices 18 can be configured to operate separately from one another. In some embodiments, a first set of illumination devices 18 can be configured to emit either a brighter or duller light than the remainder of the first set of illumination devices 18. Also, in some embodiments, the illumination devices 18 can be configured in any conventional manner to have one or more dimmed settings or can be controllable in a range of brightness.

In some embodiments, the region 38 can include a set of step members 48. In some embodiments, the set of step members 48 can be one step member 48, however, in some embodiments the set of step members 48 can be more than one step member 48, such as four step members 48. In some embodiments, the step members 48 can outwardly extend from the region 38. In some embodiments, the step members 48 can outwardly extend directly from the grille 32. The step members 48 can take a generally rectangular form in some embodiments, although in some embodiments, the step members 48 can take other forms, including square, oval, polygonal, elliptical, or any other shape. In some embodiments, the step members 48 can be integral with the region 38 or the grille 32. In some embodiments, the step members 48 can be separate subunits of the system 10 and can be coupled to the region 38 or the grille 32 in any suitable manner.

As illustrated in FIGS. 3 and 4, in some embodiments, the step members 48 can include a support flange 50, although not all step members 48 included in the system 10 need to include a support flange 50. In some embodiments, the support flange 50 can be positioned on each step member 48 at an end which generally can be the most radially distal relative to the region 38. In some embodiments, the support flange 50 can be positioned anywhere along the length of the step members 48. In some embodiments, the support flange 50 can be integral with the step members 48, however, in other embodiments, the support flange 50 can be coupled to the step members 48 in any suitable manner, which can include using any of the coupling techniques described above.

Referring now to FIG. 4, in some embodiments, each of the step members 48 can include a support slot 52. The support slot 52 can be defined by an area along a surface of the step members 48 near the support flange 50. In some embodiments, the support slot 52 can be sized to support a plate 54 of the system 10. The support slot 52 and the support flange 50 together can, at least partially, enable installation of the plate 54 onto the system 10. In some embodiments, the support slot 52 can be any size which can be coordinated with any functionality the user and/or manufacturer desires. In other embodiments, the plate 54 can be installed by any other suitable methods and the support slots 52 can be absent.

Referring to FIG. 4, in some embodiments, an area of each of the step members 48 adjacent to the support slots 52 can include an illumination aperture 56. In some embodiments, the illumination apertures 56 can be located relatively centrally with respect to the support slots 52, however, in other embodiments, the illumination apertures 56 can be located anywhere within the support slots 52. In other embodiments, the illumination apertures 56 can be located anywhere along the step members 48. In some embodiments, there can be any number of illumination apertures 56 on the system 10, including one per step member 48, two per step member 48, three per step member 48, and so forth. Further, in some embodiments, some or all of the step members 48 can lack illumination apertures 56.

In some embodiments, the illumination apertures 56 can contain electrical connections which can be used to provide power to a second set of illumination devices 58. The electrical connections can be positioned substantially within the step members 48. More specifically, in some embodiments, the step members 48 can be at least partially hollow or the step members 48 can contain a recess within them. In some embodiments, the electrical connections can be positioned within the hollow area of the step members 48. In some embodiments, the electrical connections can be part of a larger network of electrical components which can be connected to a user interface which the user can use to control the system 10. In some embodiments, the step members 48 can be substantially solid (i.e., substantially lacking any hollow areas) and the electrical connections can be positioned elsewhere on the system 10.

In some embodiments, the illumination apertures 56 can include the second set of illumination devices 58. The second set of illumination devices 58 can by of any type suitable to illuminate a room, area, space, or can be used to illuminate the plate 54. In some embodiments, the second set of illumination devices 58 can comprise LEDs, although, in some embodiments, the second set of illumination devices 58 can include incandescent, fluorescent, compact fluorescent, halogen, or any other type of illuminating apparatuses, including a combination of any of the above. In some embodiments, the number of illumination apertures 56 and the number of the second set of illumination devices 58 can be substantially the same (i.e., four illumination apertures and four illumination devices). In other embodiments, the number of illumination apertures 56 and the number of the second set of illumination devices 58 can be different, although in some embodiments, more than one illumination device 58 can be installed within one illumination aperture 56. Further, one or more of the second set of illumination devices 58 can be configured in any conventional manner to have one or more dimmed settings or to be controllable in a range of brightness.

Figure 8:
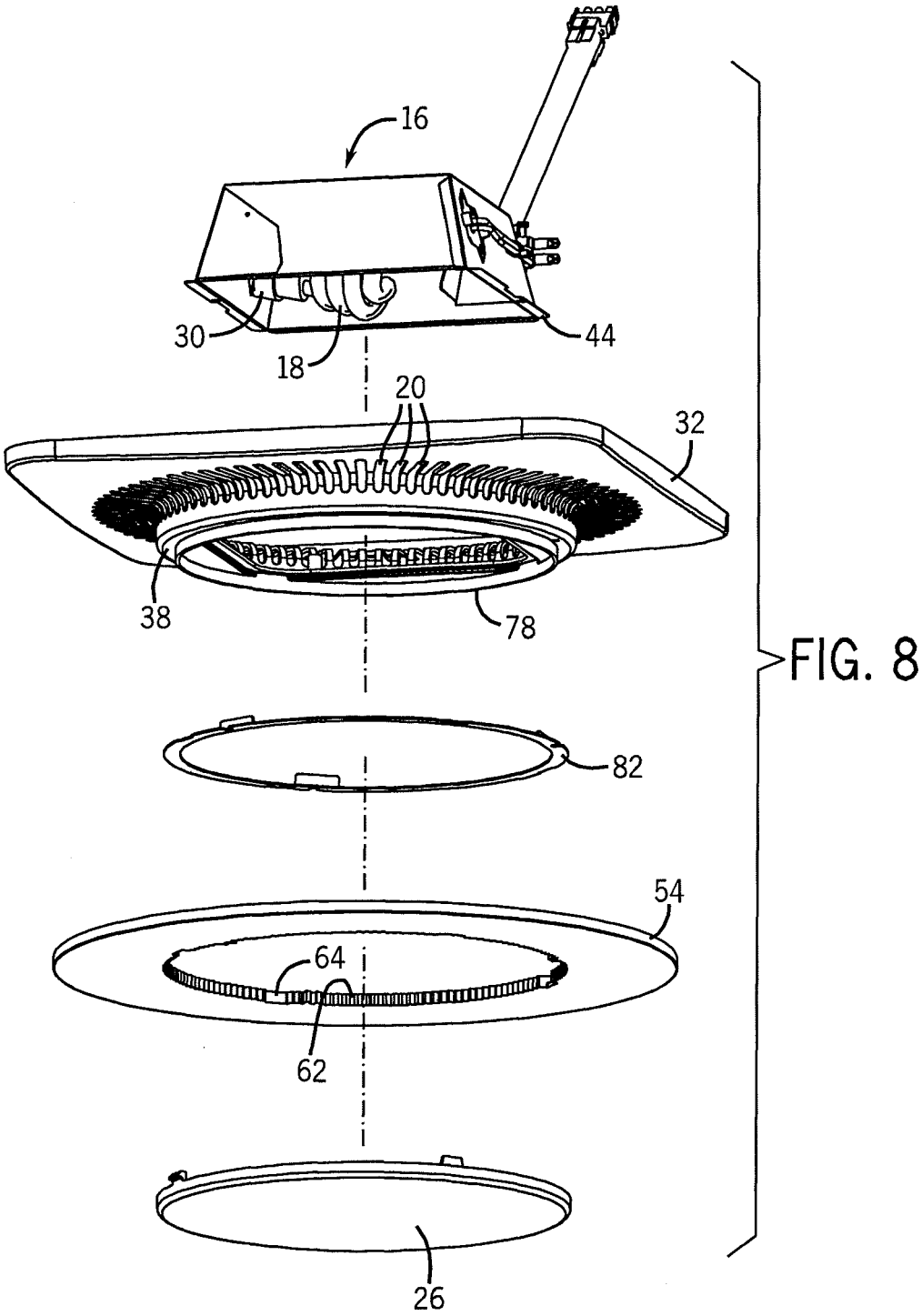
FIG. 8 is an exploded view of a lighting and ventilating system according to one embodiment of the invention.

Referring to FIG. 8, in some embodiments, the second set of illumination devices 58 can comprise a lighting strip or ribbon 82. In some embodiments, the step members 48, or an annular structure 78 that can be generally positioned on or in the grille 32 or region 38, can support the ribbon 82 to provide more even lighting about the periphery of a portion of the region 38 or the grille 32. In some embodiments, the ribbon 82 can comprise incandescent, fluorescent, compact fluorescent, halogen, and other lights and lamps. Further, the ribbon 82 can comprise flood lights, globe lights, LEDs, or other similar lighting apparatuses, including a combination of any of the above. In some embodiments, electrical connections can be coupled to the ribbon 82 so that the ribbon 82 can receive power. In some embodiments, the electrical connections can be part of a larger network of electrical components which can be connected to a user interface which the user can use to control the system 10.

In some embodiments of the invention, the second set of illumination devices 58 can be configured to operate independently of the first set of illumination devices 18. In some embodiments, the second set of illumination devices 58 can be configured to substantially automatically emit illumination when the area around the system 10 substantially lacks illumination (i.e., operate as a "night light"). In some embodiments, the second set of illumination devices 58 can be configured to emit illumination at the command of the user. The command of the user can include the user manually activating the second set of illumination devices 58, the user pre-programming automatic activation of the second set of illumination devices 58, the user pre-selecting times of the day for activation of the second set of illumination devices 58, or any other user-based commands. In some embodiments, both the first set 18 and the second set of illumination devices 58 can be configured to illuminate the same space at the same time.

Referring to FIG. 2, in some embodiments, the second set of illumination devices 58 can be configured to operate in cooperation with the first set of illumination devices 18. In some embodiments, the first set 18 and the second set of illumination devices 58 can be configured to be, at least partially, controlled by a motion-sensing monitor. In some embodiments, the motion-sensing monitor can activate the first set of illumination devices 18 when it detects any general movement and the monitor can activate the second set of illumination devices 58 after no movement is detected for any chosen duration. In some embodiments, the motion-sensing monitor can deactivate the first set of illumination devices 18 when it activates the second set of illumination devices 58, and vice versa. Further, in some embodiments, the second set of illumination devices can be activated and the first set of illumination devices can be deactivated when the space is generally unoccupied by a user and generally lacks other illumination. Conversely, the second set of illumination devices can be deactivated and the first set of illumination devices can be activated when the space is generally occupied by the user.

In some embodiments, the plate 54 can be included in the system 10. In some embodiments, the plate 54 can be formed from glass, acrylic, injection-molded polymers, or any other similar material. In some embodiments, the plate can be formed such that it is substantially transparent. In other embodiments, the plate can be formed such that it can be substantially translucent, opaque, or any other light-transmissive state within the range of any of the above. Further, in some embodiments, the plate 54 can include different regions which can include different light-transmissive properties.

In some embodiments, the plate 54 can be generally colorless (i.e., lacking all tint). In other embodiments, the plate 54 can include a tint. Further, in some embodiments the tint color can include green, blue, red, orange, violet, yellow, or any other color or combination of colors (not shown).

In some embodiments, the plate 54 can be formed so that it can take a generally annular shape. In other embodiments, however, the plate 54 can take any shape, including, but not limited to a square, rectangle, polygon, ellipse, oval, or any other shape. Also, in some embodiments, the plate 54 can have a substantially irregular shape.

In some embodiments, the plate 54 can be of a size substantially similar to the grille 32. In some embodiments, however, the plate 54 and the grille 32 can be of generally different sizes. The plate 54 can be either a larger size or a smaller size than the grille 32.

In some embodiments, the plate 54 can include a substantially non-textured or smooth surface. In other embodiments, the plate 54 can include a non-homogenous surface so that the surface of the plate 54 can be, at least partially, textured. In some embodiments, the plate 54 can be manufactured as a single unit. In some embodiments, the plate 54 can be manufactured as multiple units and those multiple units can be coupled using any one or combination of the coupling techniques discussed above.

Figure 6:
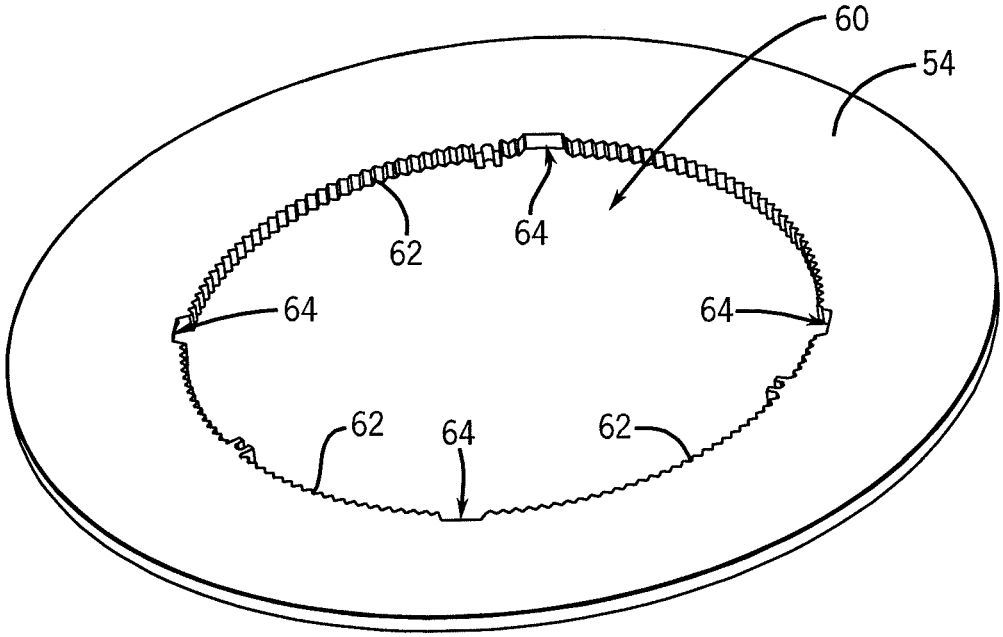
FIG. 6 is a perspective view of a lighting and ventilating system according to one embodiment of the invention.

Referring to FIGS. 3 and 6, according to some embodiments of the invention, the plate 54 can include a plate aperture 60. In some embodiments, the plate aperture 60 can be located substantially centrally on the plate 54. In other embodiments, the plate aperture 60 can be located anywhere along the plate 54. In some embodiments, the plate aperture 60 can take a generally annular shape so that, with inclusion of the plate aperture 60 in a generally annular-shaped plate 54, the plate 54 can take a generally ring-shaped appearance. In other embodiments, the plate aperture 60 can take any other regular or irregular shape.

In some embodiments, walls of the plate aperture 60 can include a generally smooth, non-textured surface. As seen in FIG. 6, in other embodiments, the walls of the plate aperture 60 can include a generally textured surface 62. In some embodiments, the textured surface 62 can include a generally saw-toothed texture, as can be seen in FIG. 6. In some embodiments, the textured surface 62 can substantially extend the entire circumference of the plate aperture 60. In some embodiments, the textured surface 62 can be localized only to some regions of the walls of the plate aperture 60, as shown in FIG. 2. The textured surface can help to diffuse light and provide a more even illumination pattern in some embodiments of the invention.

In some embodiments, the walls of the plate aperture 60 can include a set of mounting notches 64. In some embodiments, the set of mounting notches 64 can be of a generally semi-circular shape, although in other embodiments the set of mounting notches 64 can be a shape that is generally square, rectangular, elliptical, oval, or any other regular or irregular shape. In some embodiments, the set of mounting notches 64 can be substantially equidistantly spaced around the circumference of the plate aperture 60, although in other embodiments, the set of mounting notches 64 can be spaced in any manner desired. In some embodiments, the number of the set of mounting notches 64 can be the same as the number of step members 48. In other embodiments, the numbers of mounting notches 64 and step members 48 can be different.

Referring to FIG. 2, in some embodiments, the set of mounting notches 64 can be used to couple the plate 54 to the grille 32. In some embodiments, the plate 54 can be positioned so that each of the support flanges 50 substantially align with an area generally adjacent to each of the mounting notches 64. In some embodiments, once aligned, the plate 54 can be moved so that the plate 54 moves with respect to the support flanges 50. In some embodiments, once the mounting notches 64 are moved away from the support flanges 50, the plate 54 can now be largely supported by the support flanges 50 and the support slots 52. In some embodiments, the movement of the plate 54 can be a rotation, twist, revolving, or other similar movement.

In some embodiments, as shown in FIGS. 3, 6, and 7, the plate 54 can include a set of illumination notches 66. In some embodiments, the illumination notches 66 can be of a generally semi-circular shape, although in other embodiments the illumination notches 66 can be a shape that is generally square, rectangular, elliptical, oval, or any other regular or irregular shape. In some embodiments, the illumination notches 66 can be substantially equidistantly spaced around the circumference of the plate aperture 60, although in other embodiments, the illumination notches 66 can be spaced in any manner desired. In some embodiments, the number of the illumination notches 66 can be the same as the number of step members 48. In other embodiments, the numbers of illumination notches 66 and step members 48 can be different. In some embodiments, some or all of the illumination notches 66 can include the textured surface 62, independently of whether the remainder of the walls of the plate aperture 60 includes the textured surface 62.

In some embodiments, after the plate 54 has been coupled to the grille 32, the illumination notches 66 can substantially align with the illumination apertures 56 and the second set of illumination devices 58. In some embodiments, when the second set of illumination devices 58 are activated, the illumination notches 66 can aid in dispersing illumination to the remainder of the plate 54 and to the local environment as well. In some embodiments, the textured surface 62, whether included in the illumination notches 66 or not, can further enhance illumination distribution to the plate 54 and the local environment relative to embodiments which can substantially lack the textured surface 62. Additionally, in some embodiments, the second set of illumination devices 58 can be positioned adjacent to a reflective surface so that after activation of the second set of illumination devices 58, the second set 58 can radiate illumination generally toward the reflective surface which can reflect a substantial amount of the illumination toward the plate 54.

In some embodiments, the plate 54 can include light pipes 68. In some embodiments, the light pipes 68 can be substantially internalized within the plate 54. In other embodiments, the light pipes 68 can be coupled to a surface of the plate 54. In some embodiments, the light pipes 68 can extend from an area adjacent to each of the illumination notches 66 to an area generally adjacent to an outer perimeter of the plate 54. In some embodiments, the light pipes 68 can extend any distance from the area adjacent to each of the illumination notches 66. The light pipes 60 can aid in conducting any illumination from the second set of illumination devices 58 to the outer perimeter of the plate 54 and to the local environment.

Referring to FIG. 3, in some embodiments, the grille 32 can include a pilot light 70. The pilot light 70 can be any of the above-discussed illumination devices. In some embodiments, the pilot light 70 can be configured to radiate illumination when the ventilating assembly 14 is in a substantially operative state. In some embodiments, the ventilating assembly 14 can produce so little noise that it can be difficult to substantially audibly perceive it is in the operative state. In some embodiments, when the pilot light 70 is illuminated, an additional signal that the ventilating assembly is operating can be perceived by the user. The pilot light 70 can aid in potentially preventing unintended overuse of the ventilating assembly 14. Additionally, in some embodiments, the pilot light 70 can provide substantially green illumination, but in other embodiments, the pilot light 70 can provide any other color of illumination that would be desirable by the user and/or manufacturer.

In some embodiments, at least one of the plate's 54 light pipes 68 can be substantially aligned with the pilot light 70 so that when the grille 32 is coupled to the plate 54, the light pipe 68 is substantially adjacent to the pilot light 70. In some embodiments, this light pipe 68 can aid in conducting the pilot light's 70 illumination from the grille 32 through the plate 54 which can lead to easier visualization by the user.

As illustrated in FIGS. 1 and 3, in some embodiments of the invention, the lens 26 can be coupled to the system 10. The lens 26 can aid in diffusing illumination emitted by either the first set 18 or the second set 58 of illumination devices. In some embodiments, the lens 26 can be coupled to the grille 32 and/or the plate 54 by any of a number of the above-discussed coupling techniques, including snap-fitting, fasteners, or adhesives. Alternatively, the lens 26 can be integrally formed with either the grille 32 and/or the plate 54.

Figure 5:
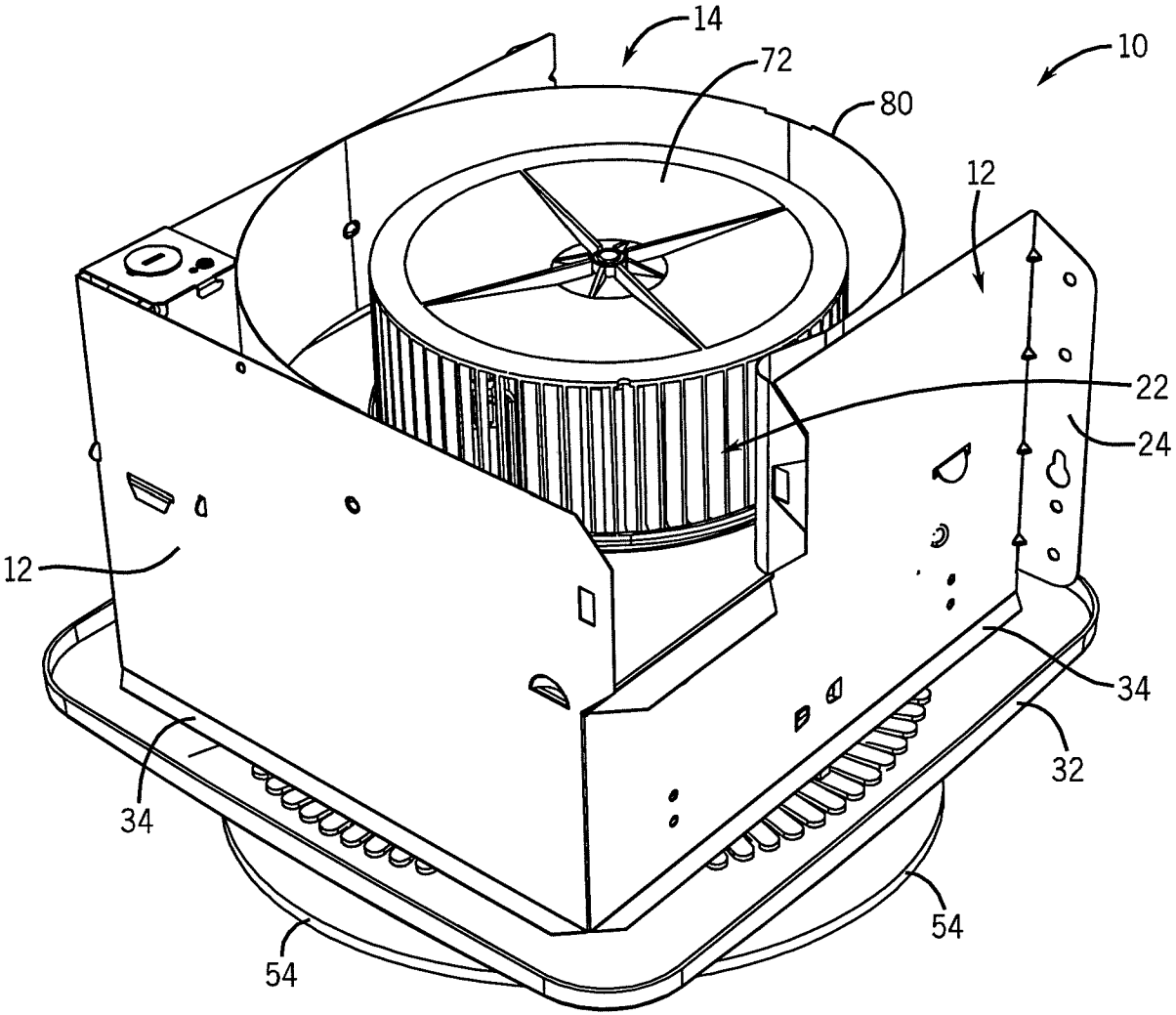
FIG. 5 is a perspective view of a plate according to one embodiment of the invention.

Referring to FIGS. 5 and 7, in some embodiments of the invention, the ventilating assembly 14 can include a centrifugal fan or fan wheel 72 connected to a motor plate 74 or other structure within the main housing 12. In some embodiments, any other type of fan other than a centrifugal or fan wheel 72 can be employed, including propeller-type fans.

In some embodiments, the system 10 can include the motor 28 connected to the motor plate 74 by a bracket 76. The motor 28 can include a motor shaft, which can extend through the bracket 76 and/or the motor plate 74 to produce ventilating airflow. In some embodiments, the ventilating assembly 14 can be removeably connected within the main housing 14 as a single integral unit.

In some embodiments, when the ventilating assembly 14 is installed within the main housing 12, the fan 72 can be supported adjacent to an arcuate, upstanding wall 80. Together with a bottom wall of the main housing 12 and the motor plate 74, the upstanding wall 80 can define a scroll housing for generating airflow. In some embodiments, the fan wheel 72 can be positioned relative to the upstanding wall 80 to form a scroll inlet to receive air through the plurality of apertures 20, and a scroll outlet to discharge air out of the ventilating outlet 22.

In some embodiments, one or more power consuming devices, including, but not limited to the motor 28, the first and second set of illumination devices 18, 58, and the pilot light 70 can be powered by an internal electrical circuit of a building. In some embodiments, one common line from one side of the main housing 12 can provide an inlet for one or more lines of power to enter the main housing 12 and power one or more of the power-consuming devices.

In some embodiments, one or more switches, such as wall switches can be used to activate or deactivate any of the power-consuming devices. In some embodiments, three separate switches can be used to control the ventilating assembly 14, the first set of illumination devices 18, and the second set of illumination devices 58. In some embodiments, one switch can be used to control all three. Further, in some embodiments, as discussed above, the motion-sensing monitor can be used to control any of the ventilating assembly 14, the first set of illumination devices 18, and the second set of illumination devices 58.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A lighting and ventilation system, comprising:

a main housing including an inlet through which air is received within the main housing and an outlet through which the air exits the main housing;

a fan wheel supported in the main housing and operable to generate a flow of air;

a lamp housing including a first set of illumination devices;

a grille coupled to the main housing, the grille defining a lamp aperture and including a second set of illumination devices, wherein the lamp housing is coupled to the grille substantially adjacent the lamp aperture.

2. The lighting and ventilation system of claim 1, wherein at least one of the first set of illumination devices and the second set of illumination devices comprises LEDs.

3. The lighting and ventilation system of claim 1, wherein the second set of illumination devices is operable independently of the first set of illumination devices.

4. The lighting and ventilation system of claim 1, wherein the second set of illumination devices comprises a lighting strip supported by an annular structure positioned on the grille.

5. A ventilation and illumination system, comprising:

a main housing including an inlet through which air is received within the main housing and an outlet through which the air exits the main housing;

a grille coupled to the main housing over the inlet of the main housing, the grille including an annular structure, the grille defining a plurality of apertures arranged across the inlet for receiving a flow of air;

a lighting strip supported by the annular structure and comprising a set of LEDs;

a lens is coupled to the grille, wherein the lens is positioned on the grille to extend over the set of LEDs; and a fan wheel supported in the main housing and operable to generate a flow of air into the grille, then into the inlet, past the fan wheel, and through the outlet.

6. The ventilation and illumination system of claim 5, wherein the lighting strip extends around a region of the grille.

7. The ventilation and illumination system of claim 6, wherein the annular structure extends around the region of the grille.

8. The ventilation and illumination system of claim 6, wherein at least one of the plurality of apertures is positioned within the region.

9. The ventilation and illumination system of claim 5, wherein the set of LEDs are coupled to at least one electrical connector.

10. The ventilation and illumination system of claim 9, wherein the at least one electrical connector is operably connected to at least one electrical component located in the main housing.

11. The ventilation and illumination system of claim 9, wherein the at least one electrical connector is operably connected to a user interface for receiving at least one command for operating the set of LEDs.

12. The ventilation and illumination system of claim 5, wherein the set of LEDs, comprises:

at least one first LED operable at a first brightness; and at least one second LED operable at a second brightness; wherein the second brightness has a lower intensity than the first brightness.

13. The ventilation and illumination system of claim 12, wherein the at least one first illumination device and the at least one second LED are operable concurrently.

14. The ventilation and illumination system of claim 12, wherein the at least one illumination device and the at least one second LED are operable sequentially.

15. The ventilation and illumination system of claim 5, further comprising:

a controller operably connected to the set of illumination devices;

wherein the controller is configured to operate the set of illumination devices at a first brightness and a second brightness, wherein the second brightness has a lower intensity than the first brightness.

16. The ventilation and illumination system of claim 5, further comprising:

a third illumination device offset from the center region.

17. The ventilation and illumination system of claim 16, further comprising:

a controller operably connected to the third illumination device;

wherein the controller is configured to operate the third illumination device at a first color and a second color.

* * * * *